US011470696B2

(12) United States Patent
Jang et al.

(10) Patent No.: US 11,470,696 B2
(45) Date of Patent: Oct. 11, 2022

(54) COOKING APPLIANCE WITH SLIDABLE TRAY

(71) Applicant: SAMSUNG ELECTRONICS CO., LTD., Suwon-si (KR)

(72) Inventors: Hyeong Jin Jang, Seoul (KR); Sang Jun Park, Yongin-si (KR); Woo Joo Kim, Suwon-si (KR); Han Jun Sung, Seoul (KR); Min Ho Yun, Suwon-si (KR); Kun-Woo Choi, Yongin-si (KR); Yu Jeub Ha, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 421 days.

(21) Appl. No.: 16/317,290

(22) PCT Filed: Jun. 28, 2017

(86) PCT No.: PCT/KR2017/006807
§ 371 (c)(1),
(2) Date: Jan. 11, 2019

(87) PCT Pub. No.: WO2018/012761
PCT Pub. Date: Jan. 18, 2018

(65) Prior Publication Data

US 2019/0239295 A1 Aug. 1, 2019

(30) Foreign Application Priority Data

Jul. 11, 2016 (KR) ..... 10-2016-0087690

(51) Int. Cl.
*H05B 6/68* (2006.01)
*F24C 15/16* (2006.01)
(Continued)

(52) U.S. Cl.
CPC ..... *H05B 6/687* (2013.01); *F24C 7/02* (2013.01); *F24C 15/16* (2013.01); *H05B 6/6402* (2013.01); *H05B 6/647* (2013.01); *H05B 6/782* (2013.01)

(58) Field of Classification Search
CPC ..... F24C 15/16; F24C 7/02; F24C 15/007; F24C 15/26; F24C 15/14; F24C 15/168;
(Continued)

(56) References Cited

U.S. PATENT DOCUMENTS 4,036,151 A * 7/1977 Shin ..... H05B 6/6411 219/754
5,338,922 A * 8/1994 Kim ..... F24C 15/162 219/763
5,780,821 A * 7/1998 Choi ..... H05B 6/6464 219/703

FOREIGN PATENT DOCUMENTS

DE 102014214170 A * 2/2016 ..... A47J 36/00
DE 102014214170 A1 * 2/2016 ..... A47J 36/00
(Continued)

OTHER PUBLICATIONS

International Search Report dated Oct. 26, 2017 from International Patent Application No. PCT/KR2017/006807, 5 pages.
(Continued)

*Primary Examiner* — Joel M Attey
*Assistant Examiner* — Adam Michael Eckardt
(74) *Attorney, Agent, or Firm* — Staas & Halsey LLP

(57) ABSTRACT

A cooking apparatus includes a main body having a cooking chamber, a coupler having a pair of pressure surfaces and rotatably provided, and a tray provided-to-be withdrawn from the cooking chamber by sliding movement. The tray has a pair of seating projections each capable of being brought into contact with the pair of pressure surfaces and being rotatably pushed by the coupler. Therefore it is pos-
(Continued)

sible to easily switch between the rotatable state of the tray and the state of sliding movement of the tray.

12 Claims, 23 Drawing Sheets

(51) Int. Cl.
*F24C 7/02* (2006.01)
*H05B 6/64* (2006.01)
*H05B 6/78* (2006.01)

(58) Field of Classification Search
CPC ..... F24C 15/30; F24C 7/046; A47J 31/547; A47J 36/027; A47J 36/34; A47J 37/0814; A47J 36/06; A47J 37/08; A47J 37/0807; A47J 37/0871; F27D 2099/0028; A47B 88/57; A47B 2088/401; A47B 2210/17; A47B 88/43; A47B 2210/0024; A47B 46/005; A47B 55/00; A47B 55/02; A47B 88/417; A47B 88/427; A47B 88/477; A47B 88/906; A47B 96/025; A47B 46/00; A47B 57/58; A47B 96/02; A47B 96/06; H04N 19/44; H04N 19/61; H04N 19/13; H04N 19/91; A47L 15/507; A47L 15/50; B65D 25/20; H03M 7/40; H03M 7/425; H03M 7/42; H05K 7/1421; H05K 7/1489; G06T 9/00; H05B 2206/042; H05B 6/80; H05B 6/64; H05B 6/6426; H05B 6/6408; H05B 6/6429; H05B 6/6402; H05B 6/647; H05B 6/687; H05B 6/782; H05B 6/6411; H05B 6/68; H05B 6/78; Y10S 99/14
See application file for complete search history.

(56) References Cited

FOREIGN PATENT DOCUMENTS

| | | | |
|---|---|---|---|
| JP | 8-153580 | 6/1996 | |
| KR | 2001-0047058 | * 11/1999 | ..... A47J 36/00 |
| KR | 2001-0047058 | * 6/2001 | ..... A47J 36/00 |
| KR | 10-0369831 | 1/2003 | |
| KR | 2006-0022426 | * 3/2006 | ..... H05B 6/6408 |
| KR | 10-0705066 | 4/2007 | |
| KR | 10-0782183 | 11/2007 | |
| KR | 10-1520498 | 5/2015 | |

OTHER PUBLICATIONS

Written Opinion of the International Searching Authority dated Oct. 26, 2017 from International Patent Application No. PCT/KR2017/006807, 7 pages.
Korean Office Action dated May 18, 2022 from Korean Application No. 10-2016-0087690.

* cited by examiner

【Figure 1】
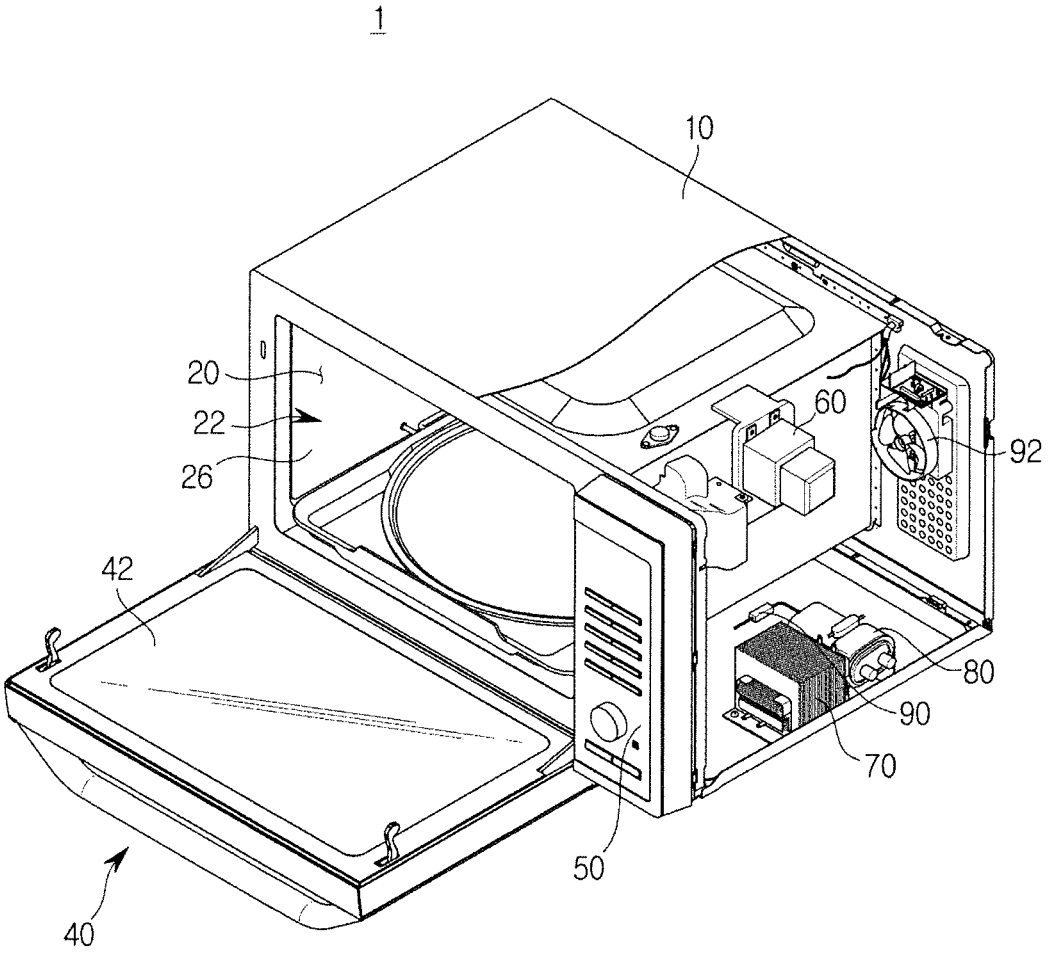

【Figure 2】
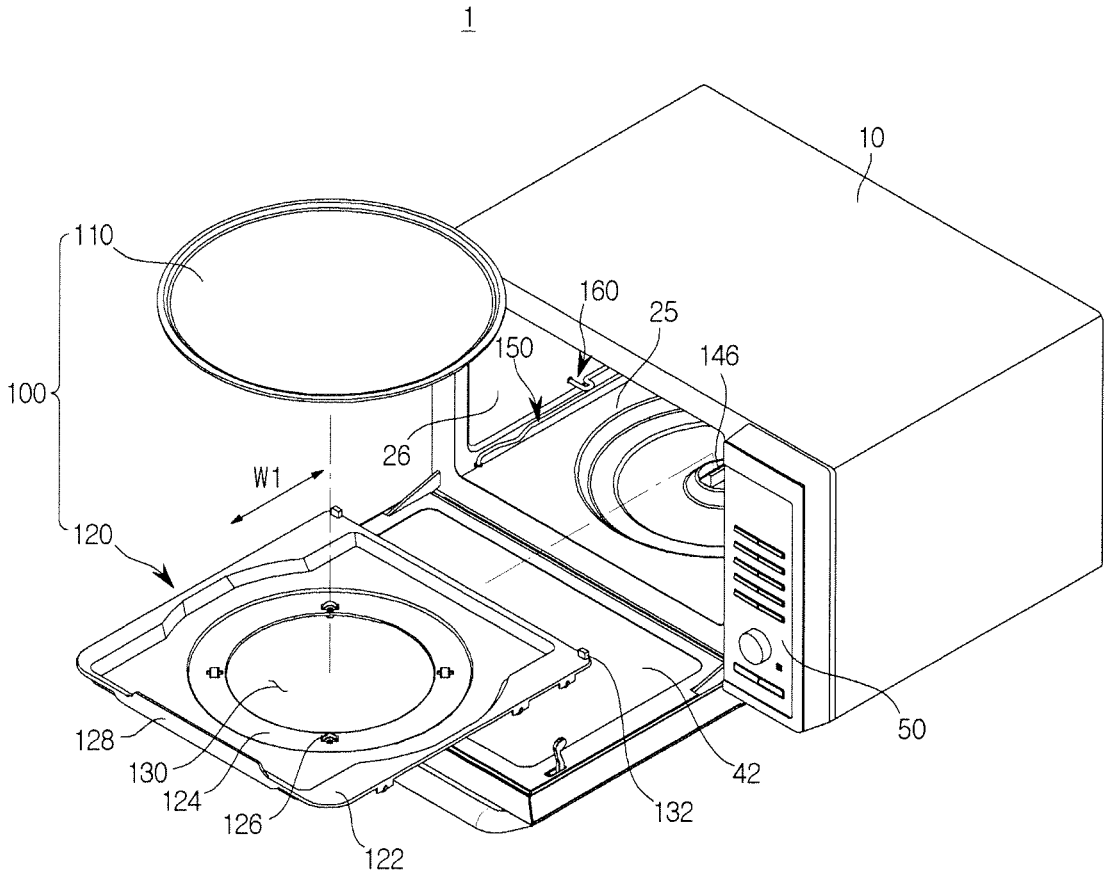

【Figure 3】
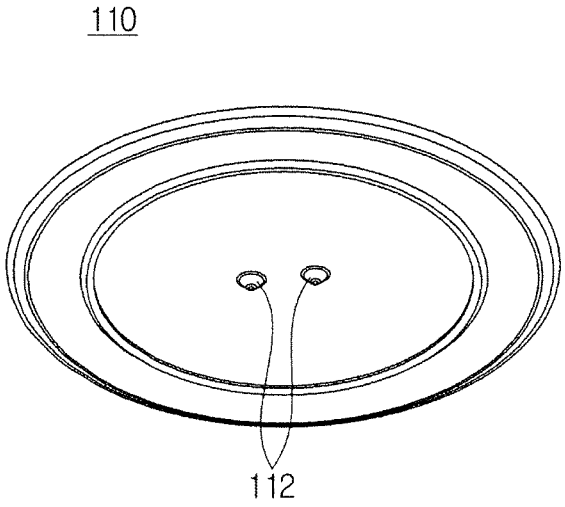

【Figure 4】
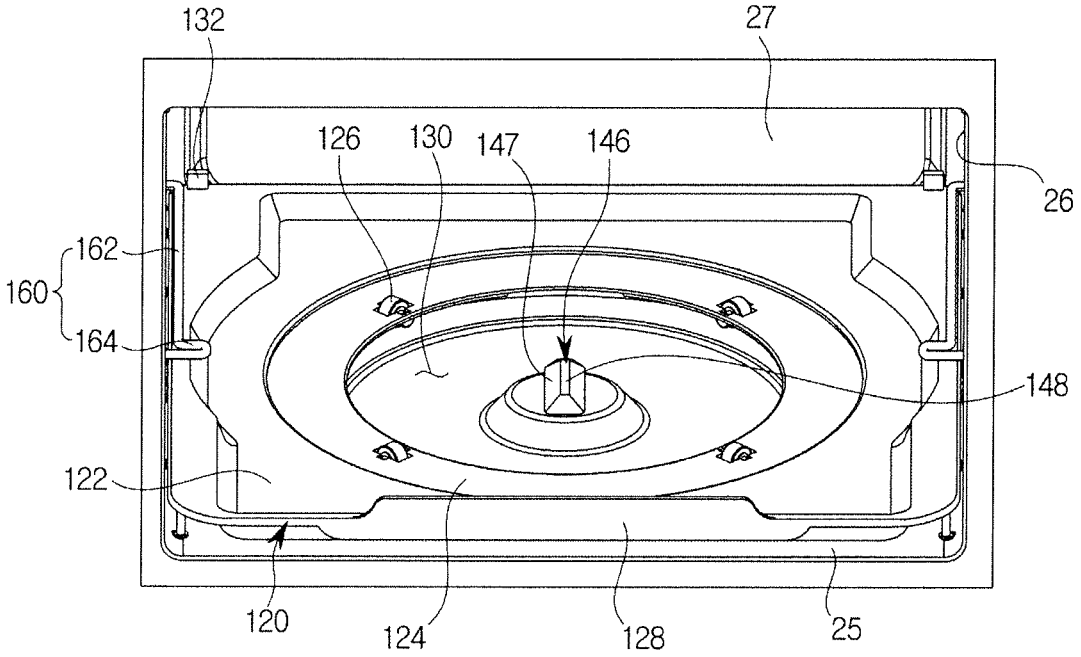

【Figure 5】
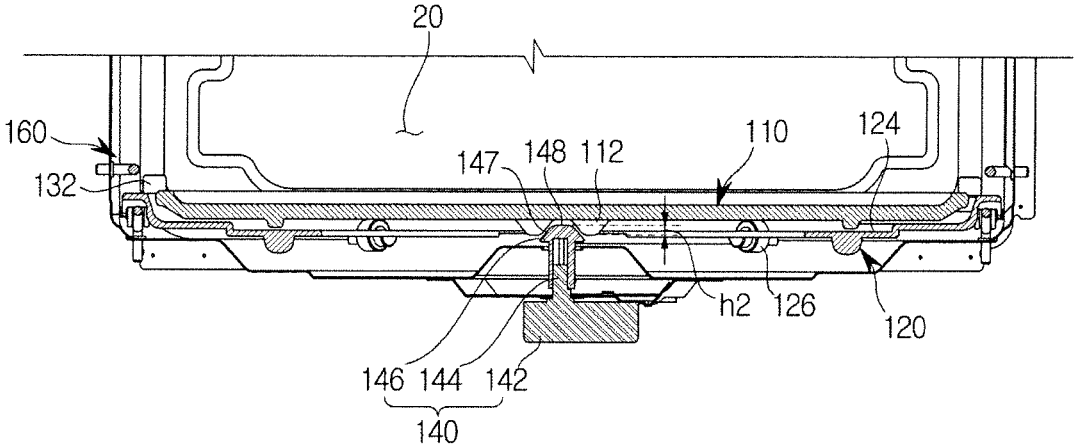

【Figure 6】
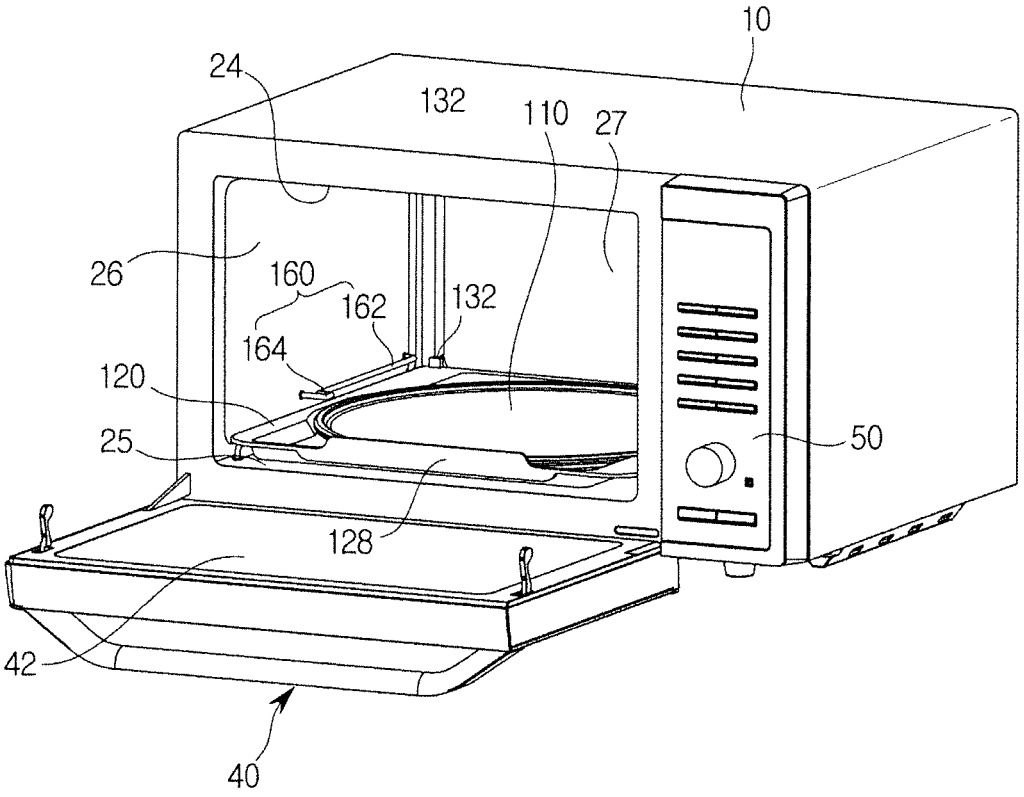

【Figure 7】
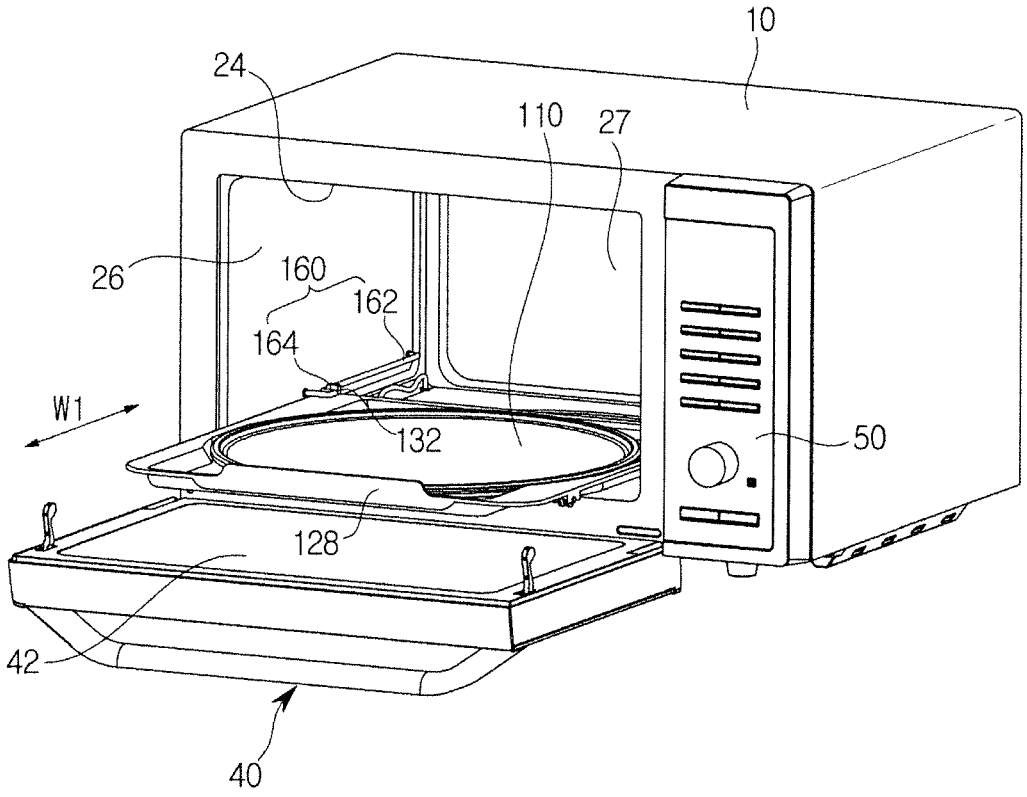

【Figure 8】
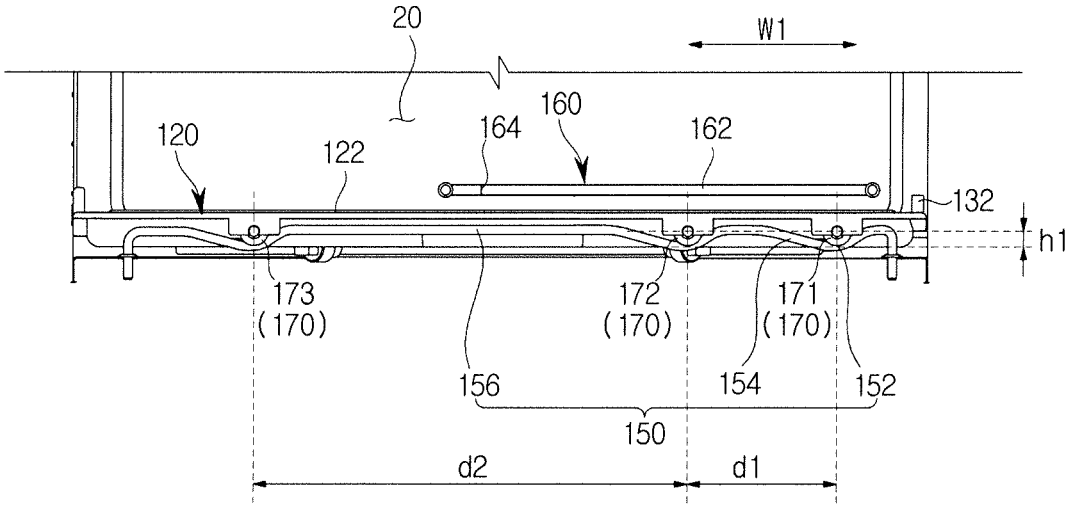

【Figure 9】
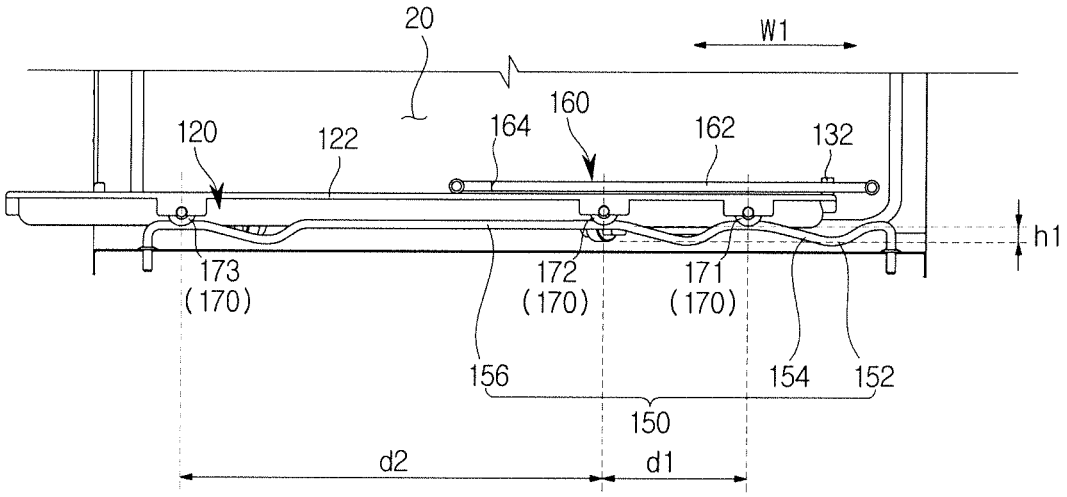

【Figure 10】
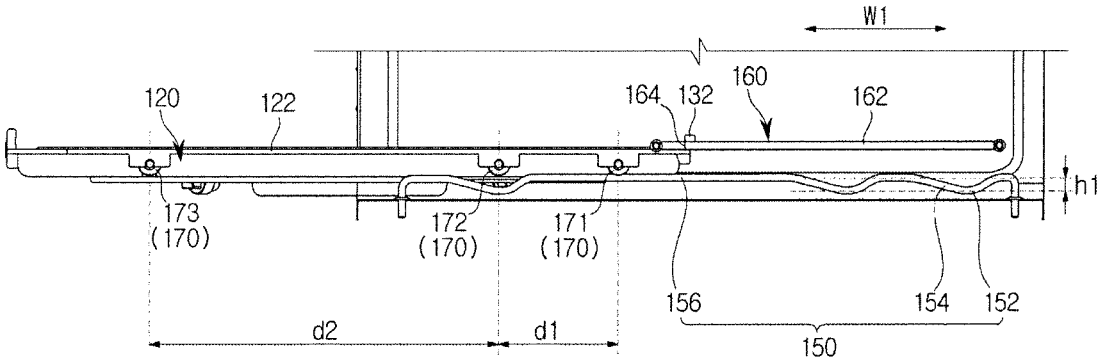

[Figure 11]
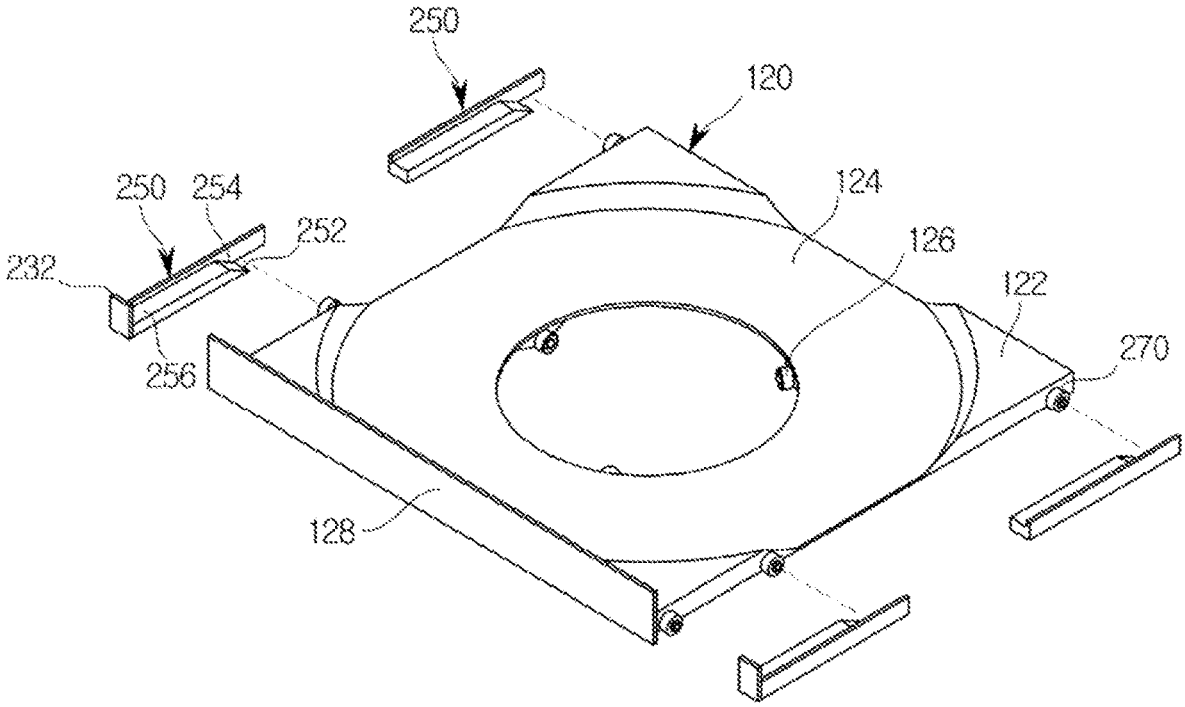

【Figure 12】
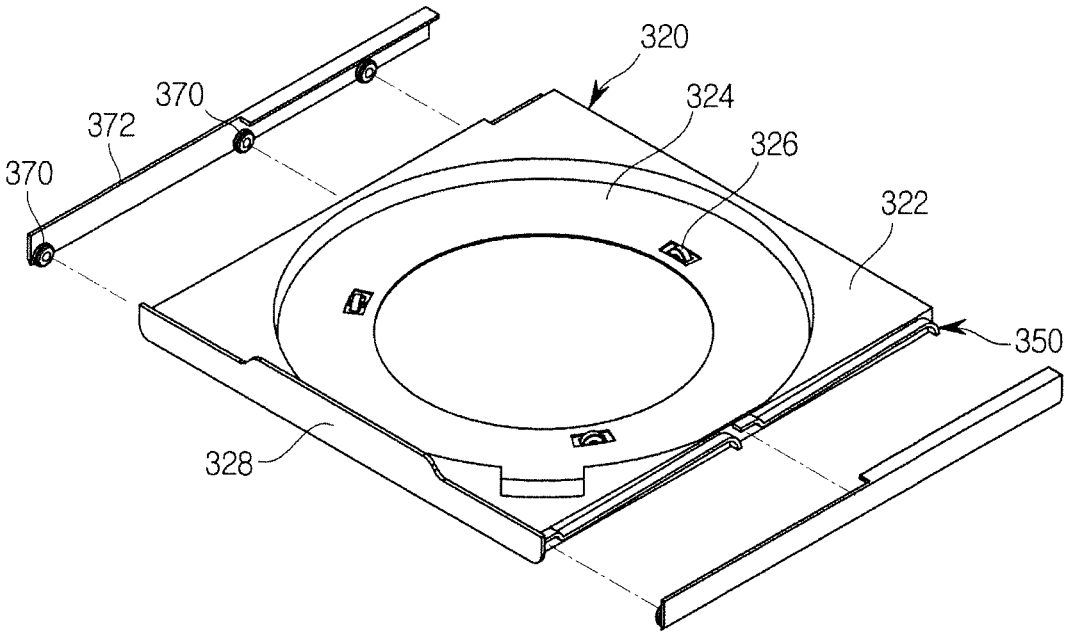

【Figure 13】
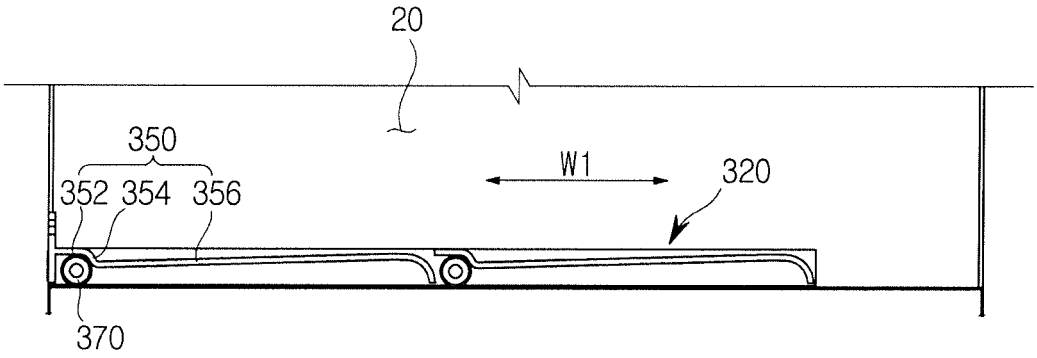

【Figure 14】
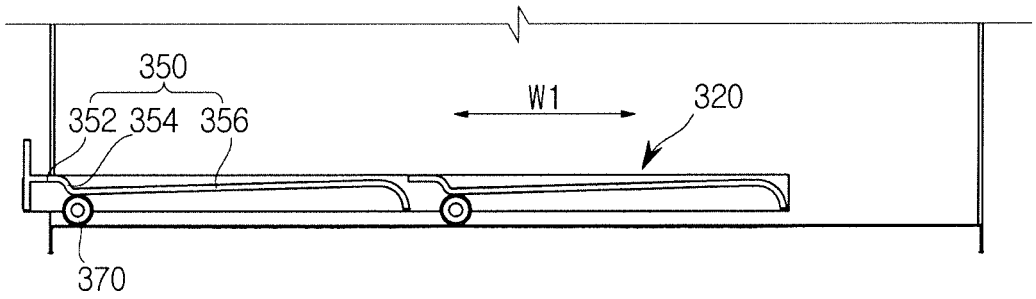

【Figure 15】
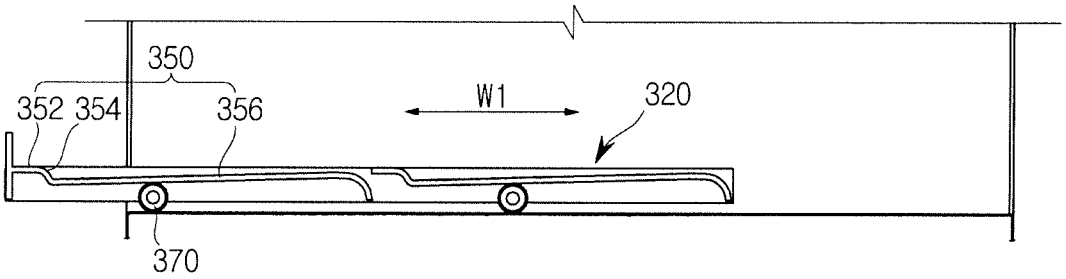

【Figure 16】
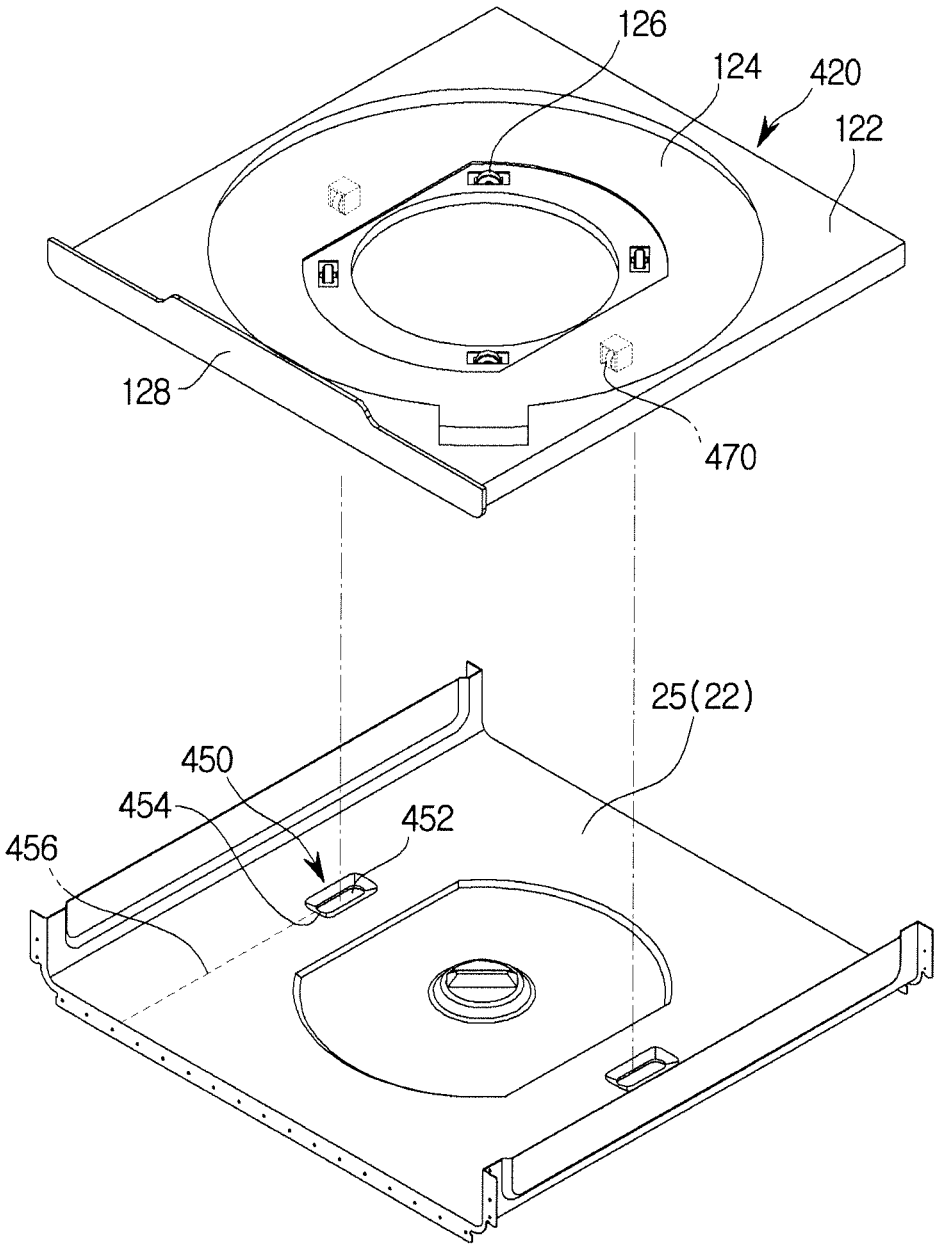

【Figure 17】
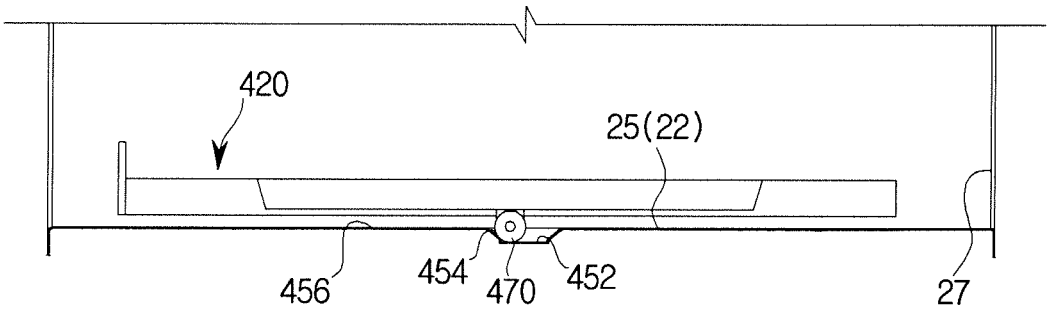

【Figure 18】
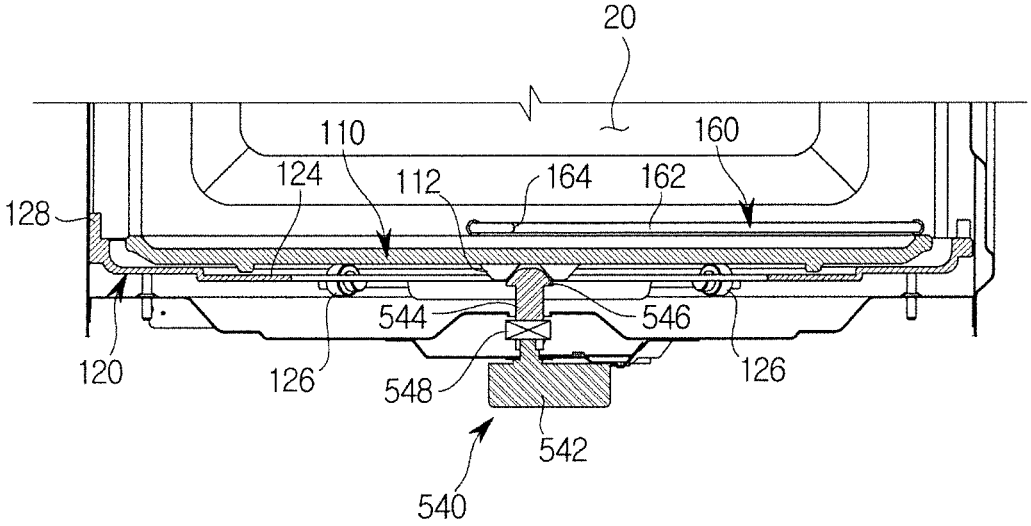

【Figure 19】
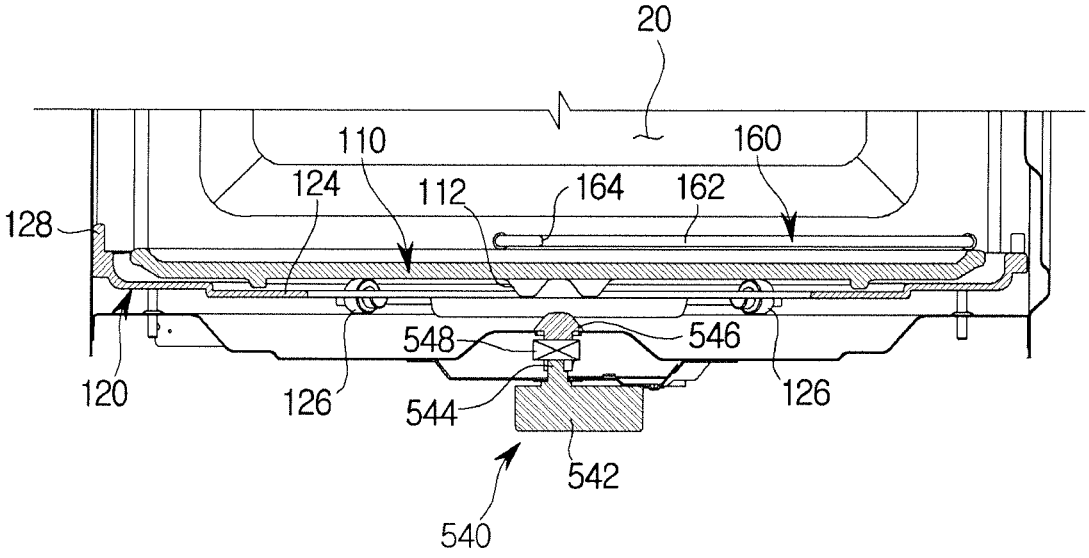

【Figure 20】
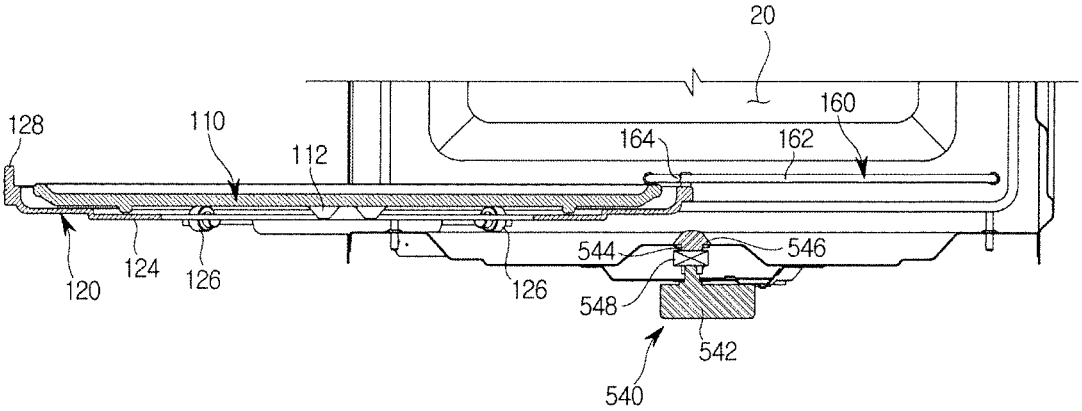

【Figure 21】
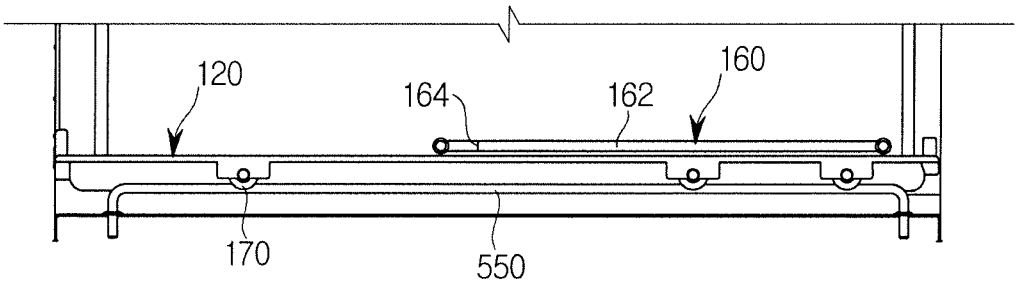

【Figure 22】
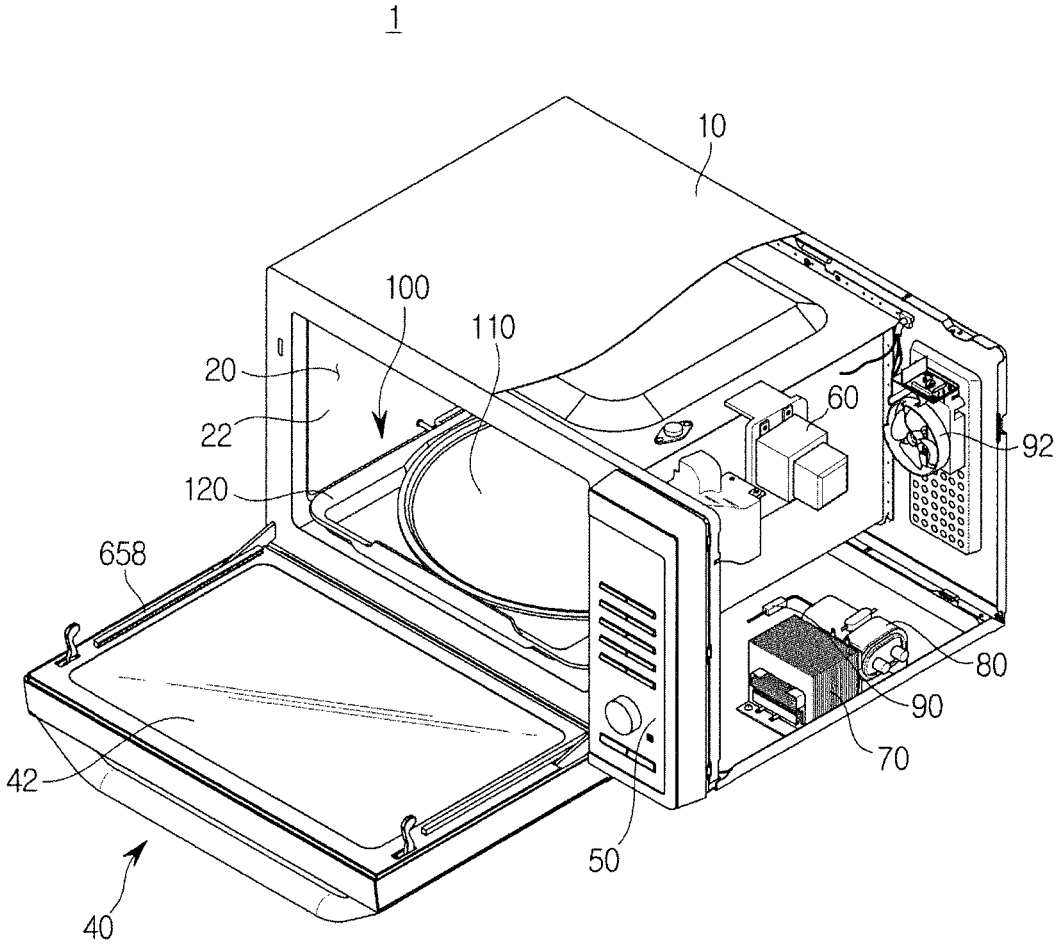

【Figure 23】
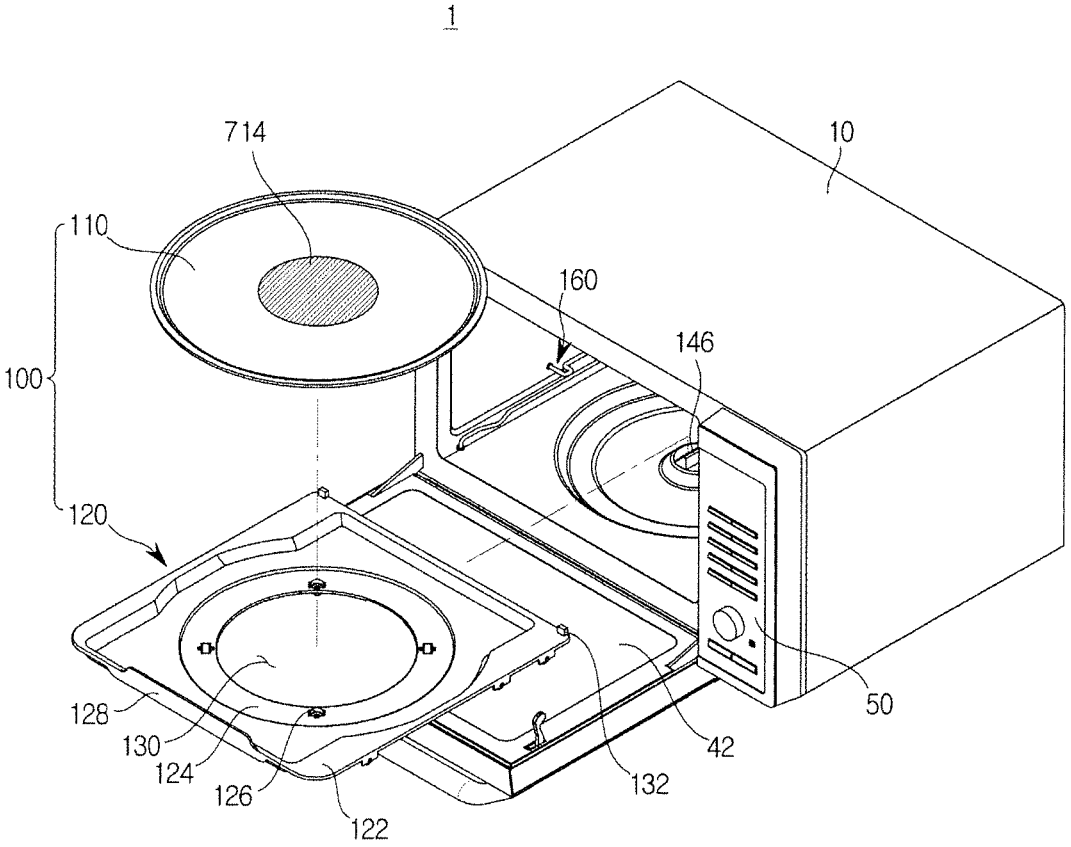

COOKING APPLIANCE WITH SLIDABLE TRAY

CROSS-REFERENCE TO RELATED APPLICATIONS

This application is a U.S. National Stage Application which claims the benefit under 35 U.S.C. § 371 of International Patent Application No. PCT/KR2017/006807 filed Jun. 28, 2017, which claims foreign priority benefit under 35 U.S.C. § 119 of Korean Patent Application No. 10-2016-0087690 filed Jul. 11, 2016 in the Korean Intellectual Property Office, the contents of both of which are incorporated herein by reference.

TECHNICAL FIELD

The present disclosure relates to a cooking appliance, and more particularly to a structure for movement of a cooking chamber tray.

BACKGROUND ART

A cooking appliance is a device that is configured to cook food. There are many types of cooking appliances, such as microwave ovens.

The microwave oven is a cooking appliance that heats food using electromagnetic waves, called microwaves. The microwave oven generates heat from the inside of the food by the dielectric heating method and warms the food. When an electromagnetic wave having a high frequency collides with the food, water molecules inside the food are rotated, and the molecular arrangement of the food is disturbed. The microwave oven heats the food using heat generated by the rotation of the water molecules.

In order to uniformly cook the food inside the microwave oven, a tray on which the food is placed is rotated. Through the rotation of the tray, the food receives microwaves in various directions.

However, when the tray has only a rotating structure, it is difficult to add another ingredient to the food or check the degree of cooking of the food during the operation of the microwave oven due to the inner wall of a cooking chamber and cavity.

DISCLOSURE

Technical Problem

It is an aspect of the invention to provide a tray provided to be withdrawable.

It is another aspect of the disclosure to provide a tray with an improved rotation structure.

It is still another aspect of the disclosure to provide a structure that is easy to switch between a pulling operation and a rotating operation of a tray.

It is still another aspect of the disclosure to provide a structure in which a tray may be stably withdrawn.

Technical Solution

In accordance with one aspect of the disclosure, a cooking appliance includes a main body with a cooking chamber, a coupler having a pair of pressure surfaces and provided rotatably, a tray provided so as to be able to be withdrawn out from the cooking chamber by sliding movement and having a pair of seating projections each capable of being brought into contact with the pair of pressure surfaces and being rotatably pushed by the coupler.

The pair of seating projections are disposed corresponding to the pair of pressure surfaces disposed on one side and the other side of the coupler, respectively, and spaced apart from the coupler when the tray is withdrawn from the cooking chamber.

The pair of pressure surfaces are inclined in directions opposite to each other at one side and the other side of the coupler.

The cooking appliance further includes a sliding member on which the tray is rotatably supported thereon, the sliding member being movable with the tray such that the tray is inserted into the cooking chamber or withdrawn from the cooking chamber.

The cooking appliance further includes a sliding rail detachably disposed in the cooking chamber to guide the movement of the sliding member.

The sliding rail includes a seating rail on which the sliding member is seated when the center of rotation of the tray is located on top of the coupler, a lifting rail extending from the seating rail and being inclined so that the sliding member may vertically move up and down together with the movement of being pulled out of the cooking chamber or inserted into the cooking chamber and a moving rail extending from the lifting rail, the moving rail being adapted to move in a direction in which the sliding member is withdrawn or inserted.

The lifting rail has a vertical height equal to or greater than a height between a lower portion of the pair of seating projections and an upper portion of the coupler.

The moving rail is configured to have a downward inclination angle in a direction in which the tray is withdrawn.

The sliding member includes a plurality of sliding rollers rotatably provided on both sides thereof and adapted to move along the sliding rail. The seating, lifting, and moving rails include a plurality of the seating rails, a plurality of the lifting rails, and a plurality of the moving rails respectively corresponding to the plurality of sliding rollers so that the sliding members may move in parallel.

The plurality of sliding rollers include a first sliding roller, a second sliding roller adjacent the first sliding roller, and a third sliding roller adjacent the second sliding roller. The spacing between the first and the second sliding rollers is different from the spacing between the second and the third sliding rollers.

The cooking appliance further includes a guide member provided to interfere with the movement of the sliding member. The guide member includes a movement restriction rail for restricting movement in a direction perpendicular to the moving direction when the sliding member moves along the sliding rail and a stopper disposed on a movement path of the restriction protrusion protruding from the sliding member to restrict the sliding member from moving over a predetermined interval.

The cooking appliance further includes a sliding roller rotatably disposed on an inner wall of the cooking chamber corresponding to a side of the sliding member. The sliding member includes a sliding rail provided on the sliding member side to guide the movement of the sliding member. The sliding rail includes a seating rail on which the sliding roller is seated when the center of rotation of the tray is located at the top of the coupler, a lifting rail extending from the seating rail and sloping downwardly from the seating rail to move upwardly with the movement of the sliding member in a pulling direction, and a moving rail extending from the lifting rail, the moving rail being provided to allow the sliding member to move in the withdrawing or insertion direction.

In accordance with one aspect of the disclosure, a cooking appliance includes a main body with a cooking chamber, a tray provided so as to be rotatable about a rotating axis and to be withdrawn from the cooking chamber by sliding movement and a coupler moving in the direction of the rotating axis to selectively contact the tray to supply rotational force to the tray.

The coupler is movable in a rotatable state in which the coupler is in contact with the tray and in a waiting state in which the coupler moves from the rotatable state and releases interference with the tray.

The cooking appliance further includes a lifting device configured to move the coupler between the rotatable state and the standby state.

The lifting device includes a solenoid valve.

The cooking appliance further includes a sliding member on which the tray is rotatably supported thereon and configured to be movable together with the tray such that the tray is inserted into the cooking chamber or withdrawn from the cooking chamber when the coupler is in the waiting state.

The cooking appliance further includes a sliding rail disposed within the cooking chamber to guide the movement of the sliding member.

In accordance with one aspect of the disclosure, a cooking appliance includes a main body with a cooking chamber, a tray rotatably provided in the main body, a sliding member that moves along a sliding rail provided in the cooking chamber and is configured to withdraw the tray and a guide member for guiding the movement of the sliding member. The guide member includes a movement restriction rail for restricting movement in a direction perpendicular to the moving direction when the sliding member moves along the sliding rail and a stopper provided on a movement path of a restriction protrusion protruding from the sliding member, the stopper restricting movement of the sliding member beyond a predetermined section.

The restriction protrusion is disposed in contact with the inside of the movement restriction rail to restrict movement of the sliding member in the horizontal direction.

Advantageous Effects

According to an aspect of the present invention, a tray can be easily withdrawn by a sliding member.

Also, it is possible to easily switch between the rotatable state of the tray and the state of sliding movement of the tray.

In addition, it is possible to facilitate detaching of the tray from the structure receiving the rotational force.

In addition, the structure is improved to guide the movement of the tray, and stable movement of the tray is possible.

DESCRIPTION OF DRAWINGS

FIG. 1 is a perspective view of a cooking appliance according to an embodiment of the present invention.

FIG. 2 is an exploded perspective view of a cooking appliance according to an embodiment of the present invention.

FIG. 3 is a bottom perspective view of a tray according to one embodiment of the present invention.

FIG. 4 is a view illustrating the interior of a cooking appliance in which a tray is removed according to an embodiment of the present invention.

FIG. 5 is a sectional view of a cooking appliance according to one embodiment of the present invention.

FIGS. 6 and 7 are diagrams illustrating the movement of a tray assembly according to one embodiment of the present invention.

FIGS. 8, 9, and 10 are views showing a relationship between sliding rails according to the movement of a tray assembly according to an embodiment of the present invention.

FIG. 11 is a diagram of a part of a cooking appliance according to another embodiment of the present invention.

FIG. 12 is a diagram of a part of a cooking appliance according to another embodiment of the present invention.

FIGS. 13, 14 and 15 are diagrams illustrating the movement of a sliding member according to another embodiment of the present invention.

FIGS. 16 and 17 are views of a part of a cooking appliance according to another embodiment of the present invention.

FIGS. 18, 19, and 20 are diagrams illustrating the movement of a tray assembly of a cooking appliance according to another embodiment of the present invention.

FIG. 21 is a view of a tray assembly and a sliding rail according to another embodiment of the present invention.

FIG. 22 is a diagram of a cooking appliance according to another embodiment of the present invention.

FIG. 23 is a diagram of a cooking appliance in accordance with another embodiment of the present invention.

BEST MODE

The embodiments described in this specification and configurations illustrated in the drawings are only exemplary embodiments and do not represent the overall technological scope of the disclosure, and it is to be understood that the disclosure covers various equivalents, modifications, and substitutions at the time of filing of this application.

Also, throughout the entire specification, the same reference numerals refer to the same components or elements to serve the same function.

Also, the terminology used herein is for the purpose of describing particular embodiments only and is not intended to be limiting to the present disclosure. Also, as used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Also, it will be understood that, although the terms including ordinal numbers such as "first," "second," etc. may be used herein to describe various elements, these elements are not limited by these terms. These terms are only used to distinguish one element from another. For example, a second element could be termed a first element without departing from the teachings of the present disclosure, and similarly a first element could be also termed a second element. The term "and/or" includes any and all combinations of one or more of the associated, listed items. Hereinafter, embodiments according to the present disclosure will be described in detail with reference to the accompanying drawings.

Hereinafter, embodiments according to the present disclosure will be described in detail with reference to the accompanying drawings.

FIG. 1 is a perspective view of a cooking appliance according to an embodiment of the present invention.

A cooking appliance 1 is formed such that a cooking chamber 20 for cooking food and an electronic chamber 30 in which various electric components are installed are formed inside a main body 10 forming an outer appearance.

The cooking chamber 20 may be partitioned from the interior of the main body 10 by a cavity 22. That is, the cavity 22 is provided so as to form the cooking chamber 20 in which the front is opened. The cavity 22 may also be formed of an upper surface plate 24 (see FIG. 6), a bottom plate 25, both side plates 26 and a back plate 27.

The cooking chamber 20 is a cooking space defined by the cavity 22. A door 40 for opening and closing the opening front of the cooking chamber 20 is hinged to one side of the main body 10. A window 42 is formed inside the door 40 so that the inside of the cooking chamber 20 may be seen through the window 42 even from outside of the cooking appliance. A control panel 50 for operating various electrical equipment inside the electronic chamber 30 is installed on the front surface of the main body 10.

A magnetron 60, a high-pressure transformer 70, a high-pressure condenser 80, and a high-voltage diode 90 are installed in the electronic chamber 30. The magnetron 60 may supply high frequency into the cooking chamber 20. The high-pressure transformer 70, the high-pressure condenser 80, and the high-voltage diode 90 may constitute a driving circuit for driving the magnetron 60. A cooling fan 92 is provided at the rear of the electronic chamber 30 to cool the various electronic components inside the electronic chamber 30 by sucking the outside air.

FIG. 2 is an exploded perspective view of a cooking appliance according to an embodiment of the present invention.

A tray assembly 100 may be provided in the cooking chamber 20. The tray assembly 100 is located inside the cooking chamber 20 and is configured to be capable of rotating or causing sliding movement for an object to be cooked.

The tray assembly 100 may include a tray 110 and a sliding member 120.

The tray 110 is provided so that the object to be cooked may be placed on the upper portion and is rotatable about a rotating axis. The tray 110 may be formed in a circular plate shape so as to smoothly rotate. However, the shape of the tray 110 is not limited thereto.

The sliding member 120 is provided to rotatably support the tray 110. Also, the sliding member 120 is provided so as to be pulled out from the cooking chamber 20 together with the tray 110. The tray 110 may be slid through the sliding member 120 to be pulled out of the cooking chamber 20 or inserted into the cooking chamber 20. This makes it easy to add ingredients while cooking, to confirm the cooking state, and the like. For convenience of explanation, a direction in which the sliding member 120 is inserted into the cooking chamber 20 or withdrawn from the cooking chamber 20 is referred to as a first direction W1.

The sliding member 120 may include a sliding member body 122, a tray seating portion 124, and a tray roller 126. A shape of a plate may be provided at a lower portion of the tray 110 so that the tray 110 of the sliding member body 122 may be supported. In this embodiment, the sliding member body 122 has a substantially rectangular plate shape, but the shape is not limited thereto.

The tray seating portion 124 is formed on the upper surface of the sliding member body 122 and is provided so that the tray 110 may be seated. The tray seating portion 124 is recessed on the upper portion of the sliding member body 122 so that the tray 110 may be stably mounted on the sliding member 120. The tray seating portion 124 may be formed to have a circular circumference corresponding to the shape of the tray 110.

The tray roller 126 is provided to facilitate the rotation of the tray 110 seated on the sliding member 120. The tray roller 126 may be positioned in the tray seating portion 124 to minimize friction with the sliding member 120 during rotation of the tray 110. A plurality of the tray rollers 126 may be provided. In this embodiment, the plurality of tray rollers 126 are arranged to be spaced apart from each other in the circumferential direction so as to rotatably support the tray 110.

The sliding member 120 may include a tray opening 130.

The tray opening 130 may be formed in the shape of a hole at the center of the sliding member 120. The tray opening 130 may be formed in the tray seating portion 124. When the tray 110 is seated in the tray seating portion 124, a seating projection 112 formed below the tray 110 may be coupled with a coupler 146 disposed below the cavity 22. For this purpose, the tray opening 130 is formed in a hole shape.

The sliding member 120 may include a handle 128.

The handle 128 is provided in front of the sliding member body 122 and is provided to allow the user to grasp the handle 128 and pull the sliding member 120 when the cooking chamber 20 is opened.

FIG. 3 is a bottom perspective view of a tray according to one embodiment of the present invention. FIG. 4 is a view illustrating the interior of a cooking appliance in which a tray is removed according to an embodiment of the present invention. FIG. 5 is a sectional view of a cooking appliance according to one embodiment of the present invention.

The tray 110 may include the seating projection 112 provided below the coupler 146 to receive a rotational force from the coupler 146. The seating projection 112 may be disposed adjacent to the center of rotation of the tray 110. In an embodiment of the present invention, a pair of the seating projections 112 is provided and the coupler 146 may be positioned between the pair of seating projections 112. The shape of the seating projection 112 is not limited, but may be formed to have a curved outer surface for efficient contact with the coupler 146. In detail, the seating projection 112 may be formed in the shape of a truncated cone. The tray 110 comes into contact with the coupler 146 and may be rotated by the coupler 146.

The cooking appliance 1 may include an actuator 140 provided to supply a rotational force to the tray 110 at the bottom of the cooking chamber 20.

The actuator 140 is a device that provides rotational driving force for rotating the tray 110. The actuator 140 may include a driving unit 142, a rotating shaft 144, and the coupler 146.

The driving unit 142 may be installed below the bottom plate 25 of the cooking chamber 20 to generate power. The rotating shaft 144 connected to the driving unit 142 may be disposed so as to protrude upward into the cooking chamber 20. The driving unit 142 may include a motor.

The actuator 140 may include the coupler 146.

The coupler 146 is connected to the rotating shaft 144 and is configured to rotate with the rotating shaft 144. The coupler 146 may be formed to have a longitudinal direction perpendicular to the rotating axis direction of the rotating shaft 144.

With this configuration, the contact area between the coupler 146 and the seating projection 112 of the tray 110 is widened so as to be easily contacted.

The coupler 146 may include a pair of pressure surfaces 147. The pair of pressure surfaces 147 may be formed on one side and the other side of the coupler 146. The coupler 146 may be formed in a bar shape having a pair of long sides and a pair of short sides, and the pair of pressure surfaces 147 may be disposed on a pair of long sides.

The pair of pressure surfaces 147 may be inclined in directions opposite to each other on one side and the other side of the coupler 146. That is, the coupler 146 may include a ridge portion 148 located between the pair of pressure surfaces 147. The pair of pressure surfaces 147 may be provided on both sides of the ridge portion 148 forming a downwardly inclined angle.

As the pair of pressure surfaces 147 are formed obliquely, it is possible to stably press the seating projection 112 on the tray 110. As will be described later, the seating projection 112 is formed as a curved surface, and the pressure surface 147 is formed as being inclined. Therefore, when the tray 110 is detached from the coupler 146, the tangent formed by the tray 110 and the coupler 146 is formed to be inclined so that it may be easily detached.

Also, a description will be made of a process in which the tray 110 is slidably moved, withdrawn from the cooking chamber 20, and then inserted again to move the tray 110 to a rotatable position. The tray 110 may be positioned so that the seating projection 112 of the tray 110 and the coupler 146 of the actuator 140 do not correspond to each other. For example, the seating projection 112 may be located above the ridge portion 148 of the coupler 146, so that the tray 110 and the coupler 146 may not be coupled. For this, the pair of seating projections 112 formed as a curved surface as described above are moved along the pair of pressure surfaces 147 which are formed to be inclined, so that they may be stably positioned.

The cooking appliance 1 may include a sliding rail 150.

The sliding rail 150 is provided to guide the movement of the tray assembly 100 when the tray assembly 100 is moved in the first direction.

The sliding member 120 may include a sliding roller 170 for rolling movement along the sliding rail 150. A plurality of the sliding rollers 170 may be disposed along the circumference of the sliding member 120.

The configuration in which the sliding member 120 moves will be described in detail later.

FIGS. 6 and 7 are diagrams illustrating the movement of a tray assembly according to one embodiment of the present invention.

The cooking appliance 1 may include a guide member 160.

The guide member 160 is provided to guide the movement of the tray assembly 100.

The guide member 160 may be formed along a movement path of the tray assembly 100. The guide member 160 is formed in the shape of a rail in this embodiment, but the shape is not limited thereto.

The guide member 160 may include a movement restriction rail 162 and a stopper 164.

The movement restriction rail 162 is provided to restrict movement of the sliding member 120 in the first direction W1 and in the direction perpendicular to the first direction.

The movement restriction rails 162 are disposed on the both side plates 26 of the cavity 22 and may be located on both sides of the sliding member 120. With this configuration, the sliding member 120 is prevented from moving upward. Also, when the sliding member 120 is pulled out, the front end of the tray assembly 100 may be prevented from being deflected downward by the weight of the tray assembly 100 or the object to be cooked on the tray assembly 100.

The sliding member 120 may also include a restriction protrusion 132 protruding from the sliding member body 122. In this embodiment, a pair of the restriction protrusions 132 may be provided, and the pair of restriction protrusions 132 may be disposed in contact with the inside of the pair of movement restriction rails 162, respectively. Thus, when the sliding member 120 is pulled out, it is possible to restrict the movement of the tray assembly 100 in the lateral direction.

The stopper 164 is provided to prevent the sliding member 120 from moving over a predetermined interval. The stopper 164 may be integrally formed with the movement restriction rail 162 or may be disposed inside the cavity 22 as a separate structure. The stopper 164 of the guide member 160 is positioned on the movement path of the restriction protrusion 132 to prevent the sliding member 120 from being withdrawn over a predetermined interval.

FIGS. 8, 9, and 10 are views showing a relationship between sliding rails according to the movement of a tray assembly according to an embodiment of the present invention.

The sliding member 120 rotatably supports the tray 110 and is provided to be able to be withdrawn from the cooking chamber 20 together with the tray 110.

The sliding rail 150 is provided to guide the movement of the sliding member 120 of the tray assembly 100. The sliding rail 150 is provided so that the sliding roller 170 of the sliding member 120 may roll.

The sliding rail 150 may be disposed within the cooking chamber 20 to guide the movement of the sliding member 120. Also, the sliding rail 150 may be detachable from the bottom plate 25 of the cavity 22 forming the cooking chamber 20.

The sliding rail 150 may include a seating rail 152, a lifting rail 154, and a moving rail 156. The seating rail 152, the lifting rail 154, and the moving rail 156 may be provided so that the sliding roller 170 does not break as a rolling movement section. That is, the seating rail 152, the lifting rail 154, and the moving rail 156 may be integrally formed.

The seating rail 152 is adapted to seat the sliding roller 170 when the tray 110 is in a rotatable state.

The moving rail 156 is provided to extend along the first direction W1 so that the sliding member 120 may move in the first direction W1. The moving rail 156 may be provided horizontally. However, the present invention is not limited to this, and the moving rail 156 may be provided so as to have a downward inclination angle toward the front. When the moving rail 156 is formed at a downward inclination angle, the tray assembly 100 may be slid by the weight of the tray assembly 100 past the lifting rail 154 to be pulled forward.

The lifting rail 154 may be provided between the seating rail 152 and the moving rail 156. The lifting rail 154 may be inclined so that the sliding movement of the sliding member 120 together with the sliding member 120 is moved in the withdrawing direction. The lifting rail 154 is provided so that the sliding member 120 may move downward when the sliding member 120 moves in the insertion direction.

The moving rail 156 may be formed to be higher than the seating rail 152 by a first height h1. That is, the height of the lifting rail 154 may be set to have the first height h1. The seating projection 112 of the tray 110 must be released from the coupler 146 in order for the tray 110 to move in the withdrawing direction. To this end, the sliding roller 170 is moved from the seating rail 152 through the lifting rail 154 to the moving rail 156 during the sliding of the sliding member 120. The sliding member 120 moves upward by the first height h1. The seating projection 112 of the tray 110 is allowed to move in the withdrawing direction by being disengaged from the coupler 146.

Conversely, in the process of inserting the sliding member 120, the sliding roller 170 moves down the lifting rail 154 from the moving rail 156 to the seating rail 152 and moves downward by the first height h1. The seating projection 112 of the tray 110 becomes engageable with the coupler 146.

In other words, the height between the bottom of the seating projection 112 and the top of the coupler 146 may be referred to as a second height h2. The first height h1 may be equal to or greater than the second height h2 (see FIG. 5).

A plurality of the sliding rollers 170 of the sliding member 120 may be provided. The spacing distance between the plurality of sliding rollers 170 may be different from each other.

In this embodiment, the sliding rollers 170 are referred to as first, second, and third sliding rollers 171, 172, and 173 for convenience of explanation. A first distance d1 between the first sliding roller 171 and the second sliding roller 172 and a second distance d2 between the second sliding roller 172 and the third sliding roller 173 are not the same. If the first and second distances d1 and d2 are equal to each other, in the process of withdrawing or inserting the sliding member 120, the sliding rollers 170 may be seated in the seating rail 152 other than the corresponding seating rail 152. Thus, by varying the first and second spacing distances, even if one of the sliding rollers 170 is located on the seating rail 152 other than the corresponding seating rail 152, the other sliding rollers 170 may be supported on the moving rail 156 rather than the seating rail 152 to prevent seating on the other seating rail 152.

The sliding rail 150 may correspond to a plurality of the sliding rollers 170. That is, the sliding rail 150 may include a plurality of the seating rails 152, a plurality of the lifting rails 154, and a plurality of the moving rails 156 corresponding to the plurality of sliding rollers 170. This configuration allows the plurality of sliding rollers 170 to be seated in the corresponding seating rail 152 or to move along the corresponding lifting rail 154 and the moving rail 156, respectively.

Hereinafter, a cooking appliance according to another embodiment of the present invention will be described.

The description of the configuration overlapping with the configuration described above will be omitted.

FIG. 11 is a diagram of a part of a cooking appliance according to another embodiment of the present invention.

A sliding rail 250 is provided to guide the movement of the tray assembly when a sliding member 220 is moved in the first direction W1. The sliding rail 250 may be located inside the cavity 22. In detail, at both lower corners of the cavity 22, the sliding rail 250 may be integrally formed with the cavity 22 and may be provided to be coupled to the cavity 22 as a separate structure from the cavity 22.

The sliding rail 250 may include a seating rail 252, a lifting rail 254, and a moving rail 256.

The seating rail 252, the lifting rail 254, and the moving rail 256 may be integrally formed as a section through which a sliding roller 270 moves.

The seating rail 252 is adapted to seat the sliding roller 270 when the tray 110 is in a rotatable state.

The moving rail 256 is provided to extend along the first direction so that the sliding member 220 may move in the first direction W1.

The lifting rail 254 may be provided between the seating rail 252 and the moving rail 256. The lifting rail 254 may be formed to be inclined so that the upward movement of the sliding member 220 is performed together when the sliding member 220 is moved in the withdrawing direction. The lifting rail 254 is provided so that the sliding member 220 may be moved downward when the sliding member 220 is moved in the insertion direction.

The sliding rail 250 may include a stopper 232.

The stopper 232 may be provided on the moving rail 256 to provide the path of movement of the sliding roller 270 to limit the movement of the sliding roller 270. The stopper 232 restricts the movement of the sliding roller 270, thereby preventing the sliding member 220 from being withdrawn over a predetermined interval.

Hereinafter, a cooking appliance according to another embodiment of the present invention will be described.

The description of the configuration overlapping with the configuration described above will be omitted.

FIG. 12 is a diagram of a part of a cooking appliance according to another embodiment of the present invention. FIGS. 13, 14 and 15 are diagrams illustrating the movement of a sliding member according to another embodiment of the present invention.

A sliding member 320 may include a sliding member body 322, a tray seating portion 324, a tray roller 326, and a sliding rail 350. The sliding rail 350 may be disposed on both sides of the sliding member body 322. The sliding rail 350 may be coupled to the sliding member body 322 as a separate structure from the sliding member body 322 and may be integrally formed with the sliding member body 322.

The sliding rail 350 may include a seating rail 352, a lifting rail 354, and a moving rail 356.

The seating rail 352, the lifting rail 354, and the moving rail 356 may be integrally formed as a section in which a sliding roller 370 moves in the rolling direction.

The seating rail 352 is adapted to seat the sliding roller 370 when the tray 110 is in a rotatable state.

The moving rail 356 is provided to extend along the first direction so that the sliding member 320 may move in the first direction. The moving rail 356 may be provided so as to have a downward inclination angle toward the front. When the moving rail 156 is formed at a downward inclination angle, the tray assembly 100 may be slid by the weight of the tray assembly 100 past the lifting rail 154 to be pulled forward. However, the present invention is not limited to this, and the moving rail 356 may be provided horizontally.

The lifting rail 354 may be provided between the seating rail 352 and the moving rail 356. The lifting rail 354 may be formed to be inclined so that the sliding movement of the sliding member 320 is performed together when the sliding member 320 is moved in the withdrawing direction. Conversely, the lifting rail 354 is provided so that the sliding member 320 may move downward when the sliding member 320 is moved in the insertion direction.

The sliding roller 370 may be positioned to correspond to the sliding rail 350 at the side of the sliding member 320. The sliding roller 370 is configured to be fixed to the cavity 22 by a holder 372 and may be provided rotatably with respect to the holder 372.

When the tray 110 is in the rotatable state, the sliding roller 370 is positioned on the corresponding seating rail 352. The sliding rail 350 is moved so that the sliding roller 370 contacts the seating rail 352, the lifting rail 354 and the moving rail 356 sequentially. In this process, the lifting rail 354 raises the sliding member 320 and the tray 110 to a certain height, so that the seating projection 112 of the tray 110 and the coupler 146 are separated from each other.

Conversely, when the sliding member 320 is inserted, the sliding rail 350 is moved to contact the moving rail 356, the lifting rail 354, and the seating rail 352 sequentially. In this process, the seating projection 112 of the tray 110 comes into contact with the coupler 146, and is in a state of being able to receive the rotational force from the coupler 346.

Hereinafter, a cooking appliance according to another embodiment of the present invention will be described.

The description of the configuration overlapping with the configuration described above will be omitted.

FIGS. 16 and 17 are views of a part of a cooking appliance according to another embodiment of the present invention.

The cavity 22 may include a sliding rail 450. The sliding rail 450 may be formed in the bottom plate 25 of the cavity 22. The sliding rail 450 may be recessed in the bottom plate 25.

The sliding rail 450 may include a seating rail 452, a lifting rail 454, and a moving rail 456.

The cavity 22 may include a sliding rail 450. The sliding rail 450 may be formed in the bottom plate 25 of the cavity 22. The sliding rail 450 may be recessed in the bottom plate 25.

The moving rail 456 is provided so that the sliding member 420 may move in the first direction. In this embodiment, the front portion of the seating rail 452 and the lifting rail 454 may function as the moving rail 456.

The lifting rail 454 may be provided between the seating rail 452 and the moving rail 456. The lifting rail 454 may be formed to be inclined so that the sliding movement of the sliding member 420 is performed together when the sliding member 420 moves in the withdrawing direction. In contrast, the lifting rail 454 is provided so that the downward movement of the sliding member 420 may be performed simultaneously when the sliding member 420 is moved in the insertion direction. In this embodiment, the lifting rail 454 may be formed as an inclined surface connecting a step between the seating rail 452 and the moving rail 456.

The sliding member 420 may include the sliding roller 470. The sliding roller 470 may be provided to correspond to the sliding rail 450. In this embodiment, a pair of the sliding rollers 470 is provided on the bottom surface of the sliding member 420, and a pair of the sliding rails 450 corresponding to the sliding rollers 470 may be provided. However, the number and arrangement of the sliding rail 450 and the sliding roller 470 are not limited thereto.

Hereinafter, a cooking appliance according to another embodiment of the present invention will be described.

The description of the configuration overlapping with the configuration described above will be omitted.

FIGS. 18, 19, and 20 are diagrams illustrating the movement of a tray assembly of a cooking appliance according to another embodiment of the present invention. FIG. 21 is a view of a tray assembly and a sliding rail according to another embodiment of the present invention.

The cooking appliance may include an actuator 540 configured to provide rotational force to the tray 110 at the bottom of the cooking chamber 20.

A driving unit 542 of the actuator 540 may be installed below the bottom plate 25 of the cooking chamber 20. A rotating shaft 544 connected to the driving unit 542 may be disposed so as to protrude upward into the cooking chamber 20.

The actuator 540 may include a coupler 546.

The coupler 546 is connected to the rotating shaft 544 and is configured to be rotatable with the rotating shaft 544. The coupler 546 may be disposed perpendicular to the direction of the rotating axis of the rotating shaft 544. With this configuration, the contact area between the coupler 546 and the separating member of the tray 110 is widened so as to be easily contacted.

The actuator 540 may include a lifting device 548.

The lifting device 548 is provided to move the coupler 546. The coupler 546 may move between the rotatable state and the standby state. The coupler 546 may contact a seating projection 512 of the tray 110 when in a rotatable state. Also, the coupler 546 may release the interference to the tray 110 when in the standby state. The lifting device 548 is provided to allow the coupler 546 to move between the rotatable state and the standby state.

The sliding member 120 may include the sliding member body 122 and the sliding roller 170. The sliding roller 170 may be disposed on both sides of the sliding member body 122.

The sliding member 120 may include the sliding member body 122 and the sliding roller 170. The sliding roller 170 may be disposed on both sides of the sliding member body 122.

Hereinafter, the operation of the cooking appliance according to the present embodiment will be described.

The process of puffing the tray 110 out of the cooking chamber 20 will be described.

The tray 110 is in contact with the coupler 546 and is adapted to receive the power supplied by the driving unit 542 through the coupler 546 and rotate.

The lifting device 548 is operated to move the coupler 546 from the rotatable state to the standby state. Through this operation, the seating projection 512 of the tray 110 may be separated from the interference to the coupler 546. Then, the sliding roller 570 rolls on the sliding rail 550 so that the sliding member 520 may be withdrawn.

Next, a process of inserting the tray 110 into the cooking chamber 20 will be described.

The sliding member 520 is slidably moved so that the center of rotation of the tray 110 is positioned above the coupler 546. The coupler 546 and the tray 110 may be brought into contact with each other by moving the coupler 546 from the standby state to the rotatable state through the operation of the lifting device 548.

Hereinafter, a cooking appliance according to another embodiment of the present invention will be described.

The description of the configuration overlapping with the configuration described above will be omitted.

FIG. 21 is a view of a tray assembly and a sliding rail according to another embodiment of the present invention.

The sliding rail 150 may further include an auxiliary sliding rail 658.

The auxiliary sliding rail 658 is disposed on the inner side of the door 40 and may be positioned in a direction extending from a sliding rail 650. So that the tray assembly 100 may be pulled out to the top of the door 40.

The sliding member 620 may be withdrawn to the top of the door 40 that has been folded through the sliding rail 650 and the auxiliary sliding rail 658.

Hereinafter, a cooking appliance according to another embodiment of the present invention will be described.

The description of the configuration overlapping with the configuration described above will be omitted.

FIG. 23 is a diagram of a cooking appliance in accordance with another embodiment of the present invention.

The tray 110 may include a friction member 714.

The tray assembly 100 is provided so as to be withdrawable by the sliding member 120. At this time, the object to be cooked to be placed on the tray 110 may slip off or be offset from the upper portion of the tray 110 due to the withdrawing or inserting operation of the tray assembly 100.

The sliding member 620 may be withdrawn to the top of the door 40 that has been folded through the sliding rail 650 and the auxiliary sliding rail 658.

The friction member 714 may be formed integrally with the tray 110 by injection molding, or may be configured to cover the upper surface of the tray 110 in a different configuration. The friction member 714 may comprise an elastic material.

The present disclosure has been described in detail with reference to the exemplary embodiments. However, the exemplary embodiments should be considered in a descriptive sense only, and the disclosure is not limited thereto. It will be apparent to those skilled in the art that various modifications and improvements within the scope of the disclosure may be made.

The invention claimed is:

1. A cooking appliance comprising:

a main body having a cooking chamber;

a coupler having a pair of pressure surfaces and rotatably provided;

a driver to rotate the coupler;

a lifter to move the coupler to a standby position and to a rotatable position; and a tray provided to be withdrawable from the cooking chamber by sliding movement and having a pair of seating projections each configured to contact the pair of pressure surfaces, the pair of seating projections configured to be rotatably pushed by the pair of pressure surfaces of the coupler, the coupler being movable between the standby position spaced apart from the seating projections and the rotatable position in contact with the seating projections.

2. The cooking appliance according to claim 1, wherein the pair of seating projections are disposed to correspond to the pair of pressure surfaces disposed on the coupler, respectively, and are spaced apart from the coupler when the tray is withdrawn from the cooking chamber.

3. The cooking appliance according to claim 1, wherein the pair of pressure surfaces are inclined in directions opposite to each other.

4. The cooking appliance according to claim 1, further comprising:

a sliding member on which the tray is rotatably supported thereon, the sliding member being movable with the tray as the tray is inserted into the cooking chamber or withdrawn from the cooking chamber.

5. The cooking appliance according to claim 4, further comprising: a sliding rail detachably disposed in the cooking chamber to guide the movement of the sliding member.

6. The cooking appliance according to claim 5, wherein the sliding rail includes:

a seating rail on which the sliding member is seated when the center of rotation of the tray is located on top of the coupler;

a lifting rail extending from the seating rail and being inclined so that the sliding member vertically moves up and down together with athe movement of being withdrawn from the cooking chamber or inserted into the cooking chamber; and, a moving rail extending from the lifting rail, the moving rail provided to move in a direction in which the sliding member is withdrawn or inserted.

7. The cooking appliance according to claim 6, wherein the lifting rail has a vertical height equal to or greater than a height between a lower portion of the pair of seating projections and an upper portion of the coupler.

8. The cooking appliance according to claim 6, wherein the moving rail is configured to have a downward inclination angle in a direction in which the tray is withdrawn.

9. The cooking appliance according to claim 6, wherein the sliding member includes:

a plurality of sliding rollers rotatably provided on both sides thereof and provided to move along the sliding rail, and wherein the seating rail, the lifting rail, and the moving rail include:

a plurality of the seating rails, a plurality of the lifting rails, and a plurality of the moving rails respectively corresponding to the plurality of sliding rollers, the plurality of the seating rails arranged so that the sliding members move in parallel.

10. The cooking appliance according to claim 9, wherein the plurality of sliding rollers include:

a first sliding roller, a second sliding roller adjacent to the first sliding roller, and a third sliding roller adjacent to the second sliding roller, and wherein spacing between the first and the second sliding rollers is different from spacing between the second and the third sliding rollers.

11. The cooking appliance according to claim 5, further comprising:

a guide member provided to interfere with the movement of the sliding member, and, wherein the guide member includes:

a movement restriction rail configured to restrict movement in a direction perpendicular to a direction of movement of the sliding member along the sliding rail; and a stopper disposed on a movement path of a restriction protrusion protruding from the sliding member to limit movement of the sliding member.

12. The cooking appliance according to claim 4, further comprising:

a sliding roller rotatably disposed on an inner wall of the cooking chamber to correspond to a side of the sliding member, wherein the sliding member includes a sliding rail provided on the side of the sliding member to guide the movement of the sliding member, and, wherein the sliding rail includes:

a seating rail on which the sliding roller is seated when the center of rotation of the tray is located at the top of the coupler;

a lifting rail extending from the seating rail and sloping downwardly from the seating rail to move upwardly with the movement of the sliding member in a withdrawing direction; and, a moving rail extending from the lifting rail, the moving rail provided to allow the sliding member to move in the withdrawing or insertion direction.

* * * * *